US012643727B2

(12) United States Patent
Sato et al.

(10) Patent No.: US 12,643,727 B2
(45) Date of Patent: Jun. 2, 2026

(54) GLAND PACKING

(71) Applicant: Nippon Pillar Packing Co., Ltd., Osaka (JP)

(72) Inventors: Kazuyoshi Sato, Osaka (JP); Takashi Kawasaki, Osaka (JP); Ryohei Murakami, Osaka (JP)

(73) Assignee: NIPPON PILLAR PACKING CO., LTD., Osaka (JP)

( * ) Notice: Subject to any disclaimer, the term of this patent is extended or adjusted under 35 U.S.C. 154(b) by 88 days.

(21) Appl. No.: 18/689,545

(22) PCT Filed: Oct. 6, 2022

(86) PCT No.: PCT/JP2022/037443
§ 371 (c)(1),
(2) Date: Mar. 6, 2024

(87) PCT Pub. No.: WO2023/063210
PCT Pub. Date: Apr. 20, 2023

(65) Prior Publication Data

US 2024/0383662 A1 Nov. 21, 2024

(30) Foreign Application Priority Data

Oct. 14, 2021 (JP) ..... 2021-168534

(51) Int. Cl.
*F16J 15/18* (2006.01)
*B65D 65/40* (2006.01)
(Continued)

(52) U.S. Cl.
CPC ..... *B65D 81/051* (2013.01); *B65D 65/40* (2013.01); *B65D 2581/056* (2013.01)

(58) Field of Classification Search
CPC .... F16J 15/18; F16J 15/20; F16J 15/22; F16J 15/24; F16C 17/12; F16C 29/02
(Continued)

(56) References Cited

U.S. PATENT DOCUMENTS 5,370,926 A 12/1994 Hopper
5,522,603 A * 6/1996 Naitou ..... F16J 15/30 277/539
(Continued)

FOREIGN PATENT DOCUMENTS

JP H11-336911 A 12/1999
JP 3862853 B2 12/2006
(Continued)

OTHER PUBLICATIONS

International Search Report and Written Opinion issued Dec. 6, 2022 in PCT/JP2022/037443 (Translation of ISR only).

*Primary Examiner* — Luan K Bui
(74) *Attorney, Agent, or Firm* — Panitch Schwarze Belsiario & Nadel LLP

(57) ABSTRACT

A seal layer of a gland packing is a tubular portion containing fluororesin, whose outer periphery is in closely contact with an inner periphery of a stuffing box, and whose inner periphery is in closely contact with an outer periphery of a movable shaft of a fluid device. One or more protective layers of the gland packing are annular portions containing no fluororesin. The protective layers cover at least an atmosphere-side axial end surface of the seal layer to prevent oxygen and moisture from entering the seal layer.

6 Claims, 5 Drawing Sheets

(51) Int. Cl.
*B65D 81/05* (2006.01)
*F16C 17/12* (2006.01)

(58) Field of Classification Search
USPC ..... 277/512, 534, 538–540
See application file for complete search history.

(56) References Cited

U.S. PATENT DOCUMENTS

| | | | | |
|---|---|---|---|---|
| 5,687,974 | A | 11/1997 | Wilkinson et al. | |
| 2008/0122186 | A1* | 5/2008 | Cayford | F16J 15/18 277/514 |
| 2009/0108534 | A1* | 4/2009 | Ueda | D04C 1/12 277/537 |
| 2012/0301061 | A1* | 11/2012 | Forrest | F16C 33/74 384/16 |
| 2014/0105527 | A1 | 4/2014 | Thoma et al. | |
| 2014/0314346 | A1* | 10/2014 | Thoma | F16J 15/30 384/16 |
| 2015/0159757 | A1* | 6/2015 | Kawasaki | F16J 15/22 277/537 |
| 2021/0348686 | A1 | 11/2021 | Fujiwara et al. | |

FOREIGN PATENT DOCUMENTS

| | | | |
|---|---|---|---|
| JP | 4340647 | B2 | 10/2009 |
| JP | 2015-129532 | A | 7/2015 |
| JP | 5972208 | B2 | 8/2016 |
| JP | 6182461 | B2 | 8/2017 |
| JP | 2019-196828 | A | 11/2019 |
| JP | 6603589 | B2 | 11/2019 |
| JP | 2020-084993 | A | 6/2020 |

* cited by examiner

GLAND PACKING

CROSS-REFERENCE TO RELATED APPLICATIONS

This application is a Section 371 of International Application No PCT/JP2022/037443, filed Oct. 6, 2022, which was published in the Japanese language on Apr. 20, 2023, under International Publication No. WO 2023/063210 A1, which claims priority under 35 U.S.C. § 119 (b) to Japanese Application No. 2021-168534 filed Oct. 14, 2021, the disclosures of each of which are incorporated herein by reference.

TECHNICAL FIELD

The invention relates to gland packings, in particular, ones containing fluororesin.

BACKGROUND ART

"Gland packing" collectively means packings, i.e., flexible members in the form of a strip or ring, to be packed into a stuffing box to seal a gap between an opening portion of the casing of a fluid device and a movable shaft of the fluid device, i.e., to prevent fluid leakage from the gap or entry of foreign material into the gap. The "stuffing box" is a tubular member installed within the opening portion of the casing and surrounding the movable shaft to define a packing chamber, i.e., an annular space between an inner periphery of the stuffing box and an outer periphery of the movable shaft. Within the packing chamber, either strip-shaped packings wound around the movable shaft or ring-shaped packings through which the movable shaft passes are aligned side by side along the movable shaft to form a single tubular structure. When axially compressed by an annular member referred to as "gland follower," the tubular structure radially expands and closely contacts both an inner periphery of the stuffing box and an outer periphery of the movable shaft to infill the packing chamber. Thus, the gap between the opening portion of the casing and the movable shaft is sealed. "Gland packing" can mean either each of the packings that form the tubular structure or the entirety of the tubular structure. Hereinafter, "gland packing" is used as a term that means the entirety of the tubular structure. In addition, a strip-shaped packing wound as a single ring or a ring-shaped packing, a plurality of which form the tubular structure, is referred to as "ring."

There are two types of the ring: molded packing and braided packing. The "molded packing" is a packing whose components are integrated as a single ring as follows: Within a ring-shaped mold, sheets of material are stacked one on top of another, tapes thereof are spirally wound, or grains thereof are packed, and then, the sheets, tapes, or grains are pressed. See, e.g., Patent Literatures 1 and 2. The "braided packing" is a packing in which bundles of yarns made of fibrous or tape-shaped material are formed into a single strip or ring by a twisting or braiding process. See, e.g., Patent Literatures 3 and 4.

A single gland packing may include two or more types of rings different in structure or material. See, e.g., FIG. 9 of Patent Literature 2 and FIG. 7 of Patent Literature 5. Such a gland packing is called as "combination packing set." Types of rings belonging to a combination packing set include seal packings and adapter packings, for example. "Seal packings" are rings mainly aiming at causing a gland packing to maintain necessary seal performance, and usually, placed at the axial center of the gland packing. "Adapter packings" are rings of higher mechanical strength than that of seal packings, and usually, placed at both axial ends of the gland packing to prevent extrusion of seal packings, i.e., entry of a pressed and excessively-deformed packing into gaps between a stuffing box and its surrounding members such as a gland follower. A plurality of rings forming a single gland packing may be individually packed into the stuffing box, or collectively packed thereinto after integrated with a single tubular structure. See, e.g., Patent Literature 5.

Optionally, a spacer ring, backup ring, lantern ring, or other additional ring of high mechanical strength may be incorporated into a gland packing. The spacer ring is placed between rings forming the gland packing to uniformize pressure among the rings, prevent deformation of them, or transfer heat from them. The backup ring is placed at one or both axial ends of a gland packing to prevent extrusion thereof. The lantern ring is a ring whose cross section in a plane including the center axis of the ring is H-shaped, i.e., the ring including a circumferential groove in each of its outer and inner peripheries. Usually, the groove in the outer periphery communicates with that in the inner periphery through a radial hole. The lantern ring is placed between rings forming a gland packing or on an axial side of a gland packing; the lantern ring is adjacent to a fluid inlet of the stuffing box to allow lubricant or cooling fluid, which is supplied from the fluid inlet, to flow into the grooves and throughout the circumference of the gland packing. Hereinafter, a tubular structure consisting of the gland packing and any of those additional rings is also referred to as "gland packing."

CITATION LIST

Patent Literature 1: JP 3862853 B
Patent Literature 2: JP 2020-084993 A
Patent Literature 3: JP 4340647 B
Patent Literature 4: JP 6182461 B
Patent Literature 5: JP 5972208 B
Patent Literature 6: JP 6603589 B

SUMMARY OF INVENTION

A material of gland packings mainly needs the following characteristics. (1) High heat resistance. The material can withstand temperature rises caused by friction against the movable shaft, heats from high-temperature fluids, or heats from a driver of the fluid device. (2) High chemical resistance. The material is chemically stable toward fluids. (3) Small coefficient of friction against the movable shaft. Expanded graphite is a typical kind of the material superior to those characteristics. In addition, inorganic substances such as glass, carbon, and ceramics, and fluororesin such as polytetrafluoroethylene (PTFE) are also known. In particular, fluororesin is superior to characteristics of enhancing chemical resistance of a gland packing and lowering friction coefficient thereof against the movable shaft, thus used as not only a material of rings but also an additive agent incorporated into the material by impregnation, application, or the like. See, e.g., Patent Literatures 4 and 6.

However, gland packings containing fluororesin has a problem of difficulty of maintaining a sufficiently high upper limit of operating temperature. What causes the problem is as follows. Fluororesin is oxidatively decomposed when its temperature in air exceeds a level, which is hereinafter referred to as "decomposition temperature." For example, the decomposition temperature of PTFE is 350 degrees Celsius. Furthermore, one of products of the oxidative decomposition, carbonyl fluoride ($COF_2$) reacts with moisture content in the air, thus generating hydrogen fluoride (HF). Since HF has characteristics of corroding the movable shaft, once operating temperature of a gland packing containing fluororesin exceeds the decomposition temperature of the fluororesin, corrosion by HF can appear in a surface region of the movable shaft in contact with the gland packing and its vicinity. If the corrosion is excessive, there is a risk of reduction in seal performance of the gland packing, and further, degradation in durability of the movable shaft. To avoid the risk, there is no other choice but to limit operating temperature of a gland packing containing fluororesin to the decomposition temperature of the fluororesin or less.

An object of the invention is to solve the above-mentioned problems, in particular, to provide a gland packing usable at a temperature higher than the decomposition temperature of fluororesin contained in the gland packing.

According to one aspect of the invention, a gland packing includes a seal layer and one or more protective layers. The seal layer is a tubular portion containing fluororesin, whose outer periphery is in closely contact with an inner periphery of a stuffing box, and whose inner periphery is in closely contact with an outer periphery of a movable shaft of a fluid device. Each of the protective layers is an annular portion containing no fluororesin. The protective layers cover at least an atmosphere-side axial end surface of the seal layer to prevent oxygen and moisture from entering the seal layer. Preferably, an axial thickness of each of the protective layers is 5 mm or more regardless of a diameter of the movable shaft.

In the above-mentioned gland packing according to the invention, the protective layers prevent oxygen and moisture from entering the seal layer. Accordingly, even when the temperature of the gland packing reaches the decomposition temperature of the fluororesin in the seal layer, generation of HF from the seal layer is inhibited since the seal layer lacks both oxygen required for oxidative decomposition and moisture required for generation of HF. As a result, even when the temperature of the gland packing is maintained higher than the decomposition temperature, corrosion of the movable shaft by HF hardly proceeds, and thus, the gland packing maintains its high seal performance and the movable shaft hardly loses its durability. This enables the gland packing to be used at temperatures higher than the decomposition temperature.

The above-mentioned gland packing according to the invention may be a combination packing set including a seal packing and one or more adapter packings. In this case, the seal layer may include the entirety of the seal packing, and the protective layers may include at least one of the adapter packings that abuts an atmosphere side of the seal packing. This can facilitate assembling of the gland packing from existing members.

The seal layer and the protective layers may be integrated as a single piece by compression molding. This can facilitate handling of the above-mentioned gland packing according to the invention, for example, in the work of packing it into a stuffing box.

Atmosphere ends of the protective layers may be covered with metallic plates. This can enhance the function of the protective layers that is to block oxygen and moisture, and in addition, provide the protective layers with the function of adding to the mechanical strength of the seal layer.

The above-mentioned gland packing according to the invention may further include a sacrifice member, which is an annular member abutting an atmosphere side of one of the protective layers, whichever is located on an atmosphere side of the gland packing. The sacrifice member includes sacrifice metal whose corrosion resistance to HF is poorer than that of material of the movable shaft. For example, when the material of the movable shaft is cast iron, cast steel, or stainless steel, the sacrifice metal is preferably aluminum or nickel. Preferably, the sacrifice member has a hole, dent, or groove on a surface thereof, or a cavity thereinside, and the sacrifice metal is placed within the hole, dent, groove, or cavity. For example, a lantern ring may be used as the sacrifice member.

When the above-mentioned gland packing according to the invention includes the sacrifice member, even if oxygen and moisture run through the protective layers, enter the seal layer, and then generate HF, the HF corrodes the sacrifice metal in advance of the movable shaft. This reduces an amount of HF that corrodes the movable shaft, and thus, the gland packing can more significantly delay the corrosion of the movable shaft for a longer time.

DESCRIPTION OF EMBODIMENTS

A gland packing according to an embodiment of the invention is installed into a valve, for example, to be used for sealing a gap between an opening portion of the casing of the valve and a stem of the valve. The "casing," which is also referred to as "valve body," is a box defining a flow channel inside. The "stem," which is also referred to as "spindle," is a rod-shaped member to transmit drive to the valve disc, plug, or the like by rotation around or reciprocating motion along the center axis of the member. Since destination of the drive is located within the flow channel inside the casing, the opening portion is necessary for the casing to allow the stem to penetrate therethrough. The gland packing prevents fluid leakage from the opening portion.

Structure of Ring

Figure 1A:
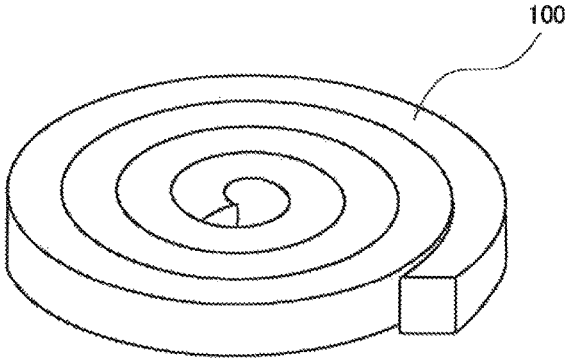
FIG. 1A is a perspective view schematically showing an appearance of a braided packing forming a gland packing according to an embodiment of the invention.
Figure 1B:
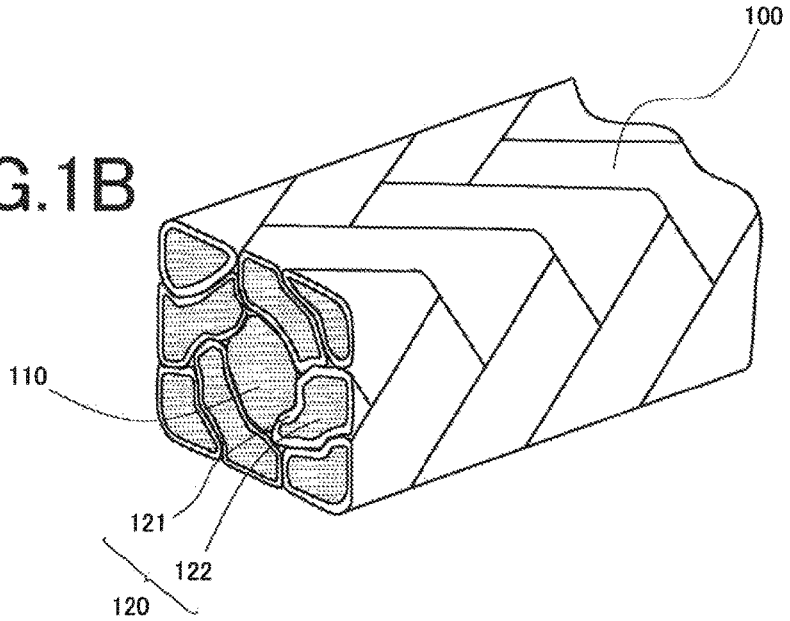
FIG. 1B is a perspective view schematically showing an appearance of a transverse cross section of the braided packing of FIG. 1A and its vicinity.

Each ring of the gland packing is made of a braided packing 100 described below, for example. FIG. 1A is a perspective view schematically showing an appearance of the braided packing 100, and FIG. 1B is a perspective view schematically showing an appearance of a transverse cross section of the braided packing 100, i.e., a cross section thereof perpendicular to the longitudinal direction thereof, and its vicinity. The braided packing 100 is a strip member whose transverse cross sections have a square shape, and whose width and thickness fall within a range from a few millimeters to several tens of millimeters, for example. The braided packing 100 includes a single center core 110 and eight yarns 120. The center core 110 is a strip of expanded graphite, and the yarns 120 are linear members consisting of expanded graphite members 122 packed within a tubular member 121. Although not shown in any figures, both the center core 110 and yarns 120 originally have transverse cross sections in the form of, for example, a circular disc with a diameter of several millimeters. In manufacturing processes of the braided packing 100, the eight yarns 120 are intertwined around the center core 110 by eight-carrier braid, for example, to create a single strip, and then, transverse cross sections of the entirety of the strip are shaped into a square by compression molding. As a result, all transverse cross sections of the center core 110 and yarns 120 are significantly deformed from the circular disc within the braided packing 100, as shown in FIG. 1B.

Figure 1C:
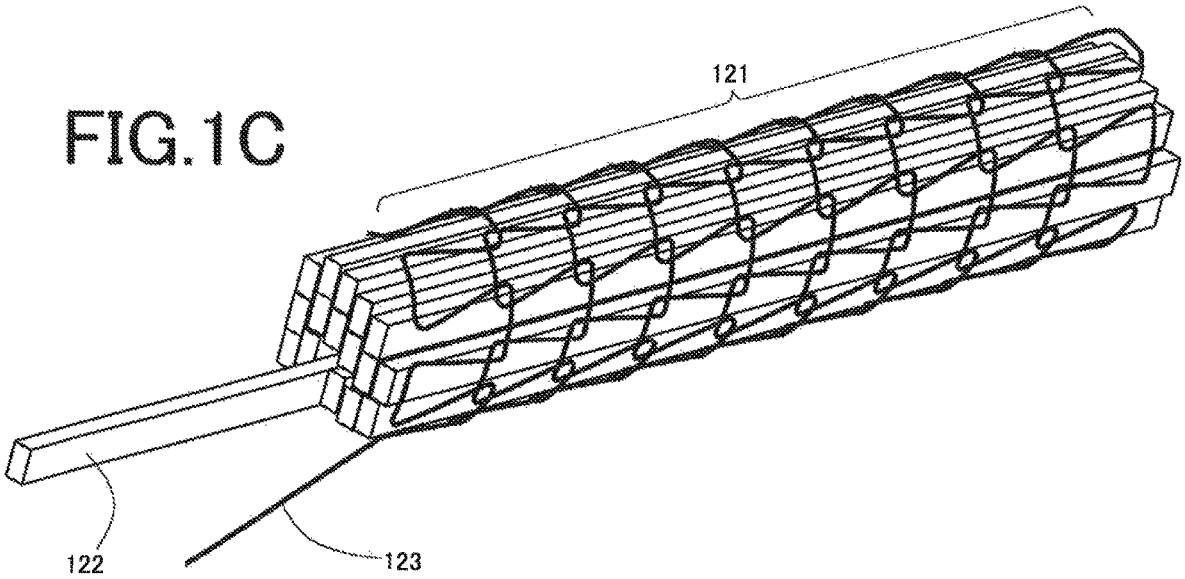
FIG. 1C is a perspective view schematically showing the structure of a yarn forming the braided packing of FIG. 1A.

FIG. 1C is a perspective view schematically showing the structure of the yarn 120. The tubular member 121 includes fibrous members 123 braided into a tube, which are made of metal such as Inconel (registered trade name) alloy or stainless steel, and whose thickness is several tenths of a millimeter, for example. Each of the expanded graphite members 122 is fibrous, for example, whose width and thickness each fall within a range from several tenths of a millimeter to several millimeters, and whose length is a few hundreds of millimeters. As shown in FIG. 1C, a plurality of the expanded graphite members 122 are packed within the tubular member 121 and tightly arranged parallel to the axial direction of the tubular member 121. Presence of the tubular member 121 not only causes the yarn 120 to be difficult to lose shape while braided into the braided packing 100 but also enhances the mechanical strength of the braided packing 100.

Furthermore, two types of the braided packing 100 are prepared; one contains PTFE as fluororesin, and another contains no fluororesin. For example, impregnation is used to incorporate PTFE into the braided packing 100. More specifically, for example, the braided packing 100 in the form of a strip as shown in FIG. 1A is immersed in a PTFE dispersion for a predetermined time, and then, it is dried until all the absorbed dispersion media, usually water, are evaporated. Thus, PTFE particulates are left in the braided packing 100.

Structure of Shaft Seal Assembly

Figure 2:
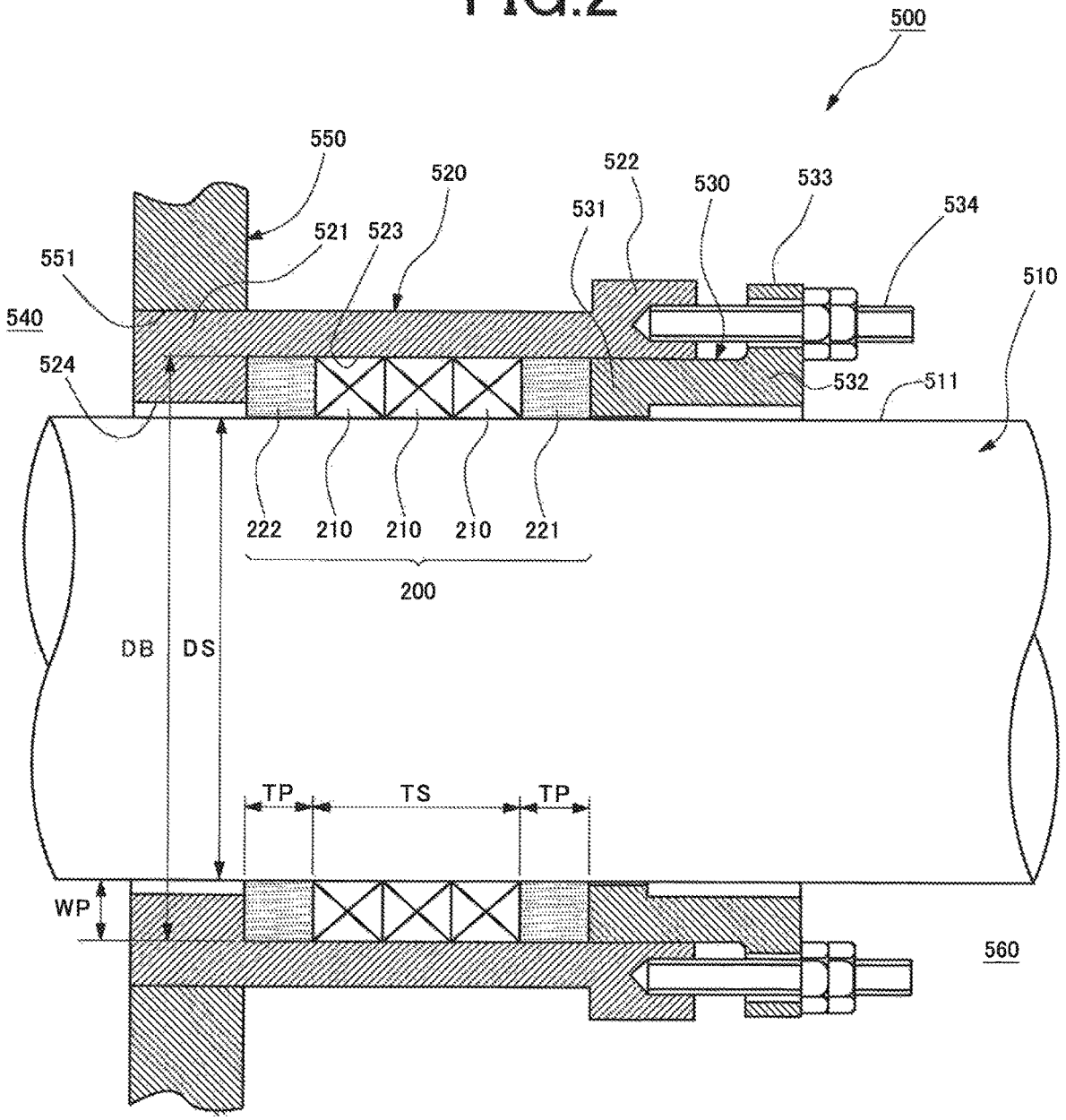
FIG. 2 is a cross-section view of the gland packing according to the embodiment of the invention and a shaft seal assembly.

FIG. 2 is a cross-section view of the gland packing 200 according to the embodiment of the invention and a shaft seal assembly 500, i.e., an assembly to use the gland packing 200 to close a gap between the stem 510 of a valve and an opening portion 551 of the casing 550 of the valve. The cross section shown in FIG. 2 includes the center axis of the stem 510. In FIG. 2, the center axis of the stem 510 is parallel to the left-right direction, and on the left side, there is a flow channel 540 inside the casing 550, and on the right side, there is an exterior space 560 of the casing 550, into and out of which outside air usually flows. Hereinafter, with respect to any position shown in FIG. 2, the left side, i.e., the side close to the flow channel 540, is referred to as "fluid side," and the right side of the position, i.e., the side far apart from the flow channel 540, is referred to as "atmosphere side."

The shaft seal assembly 500 includes a stuffing box 520 and a gland follower 530. The stuffing box 520 is a circular-cylindrical member fit inside the opening portion 551 of the casing 550 and coaxially surrounding the stem 510. The fluid-side end 521 (the left end in FIG. 2) of the stuffing box 520 faces the flow channel 540 in the casing 550, and the atmosphere-side end 522 (the right end in FIG. 2) thereof protrudes outward of the casing 550. An inner periphery 523 of the stuffing box 520 forms a circular-annular packing chamber between the inner periphery 523 and an outer periphery 511 of the stem 510. The packing chamber is filled with the gland packing 200. A circular-annular rib 524 protrudes from the fluid-side end 521 of the stuffing box 520 toward the outer periphery 511 of the stem 510 and separates the flow channel 540 and the packing chamber. The gland follower 530 is a circular-annular member coaxially surrounding the stem 510 inside the atmosphere-side end 522 of the stuffing box 520. The fluid-side end 531 (the left end in FIG. 2) of the gland follower 530 closes the atmosphere-side opening (the right opening in FIG. 2) of the packing chamber. From the atmosphere-side end 532 (the right end in FIG. 2) of the gland follower 530, a circular-annular flange 533 extends radially outward and is fixed to the atmosphere-side end 522 of the stuffing box 520 with a plurality of bolts 534.

Configuration of Gland Packing

The gland packing 200 consists of five rings 210, 221, and 222, for example. Each of the rings 210, 221, and 222 is the braided packing 100 formed into a circular-ring shape by compression molding to have the same inner diameter equal to or smaller than the diameter DS of the stem 510 and the same radial width equal to or larger than the radial span WP of the packing chamber. The rings 210, 221, and 222 are packed into the packing chamber and aligned side by side along the stem 510, and thus, the gland packing 200 forms a tubular structure. The outer periphery of the gland packing 200 closely contacts the inner periphery 523 of the stuffing box 520, and the inner periphery thereof closely contacts the outer periphery 511 of the stem 510. The fluid-side end 531 (the left end in FIG. 2) of the gland follower 530 presses the atmosphere-side end ring 221 (the right end ring in FIG. 2) of the gland packing 200 toward the fluid side thereof (leftward in FIG. 2), and then, the fluid-side end ring 222 (the left end ring in FIG. 2) of the gland packing 200 is pushed against the rib 524. This compresses the gland packing 200 axially (horizontally in FIG. 2), and thus, the gland packing expands radially (vertically in FIG. 2). As a result, the gland packing 200 more closely contacts the inner periphery 523 of the stuffing box 520 and the outer periphery 511 of the stem 510, and thus, fluid cannot infiltrate gaps among the gland packing 200 and both the peripheries 523 and 511. Therefore, a gap between the stem 510 and the rib 524 is sealed.

Three rings 210 arranged within the axial center portion of the gland packing 200 are made of the braided packing 100 containing PTFE, and two rings 221 and 222 arranged at both axial ends of the gland packing 200 are made of the braided packing 100 containing no PTFE. Hereinafter, a tubular portion consisting of the center rings 210 is referred to as "seal layer," and each annular portion formed by the end ring 221 or 222 is referred to as "protective layer."

The seal layer 210 by itself can achieve a seal performance that the gland packing 200 needs. This is because the seal layer 210 is designed to have a sufficiently large axial thickness TS. The seal layer 210 further contains PTFE, and thus its chemical resistance is sufficiently high and its coefficient of friction against the stem 510 is sufficiently low. As a result, the seal layer 210 is chemically stable toward any type of fluid with which the flow channel 540 is assumed to be filled so that the seal layer 210 keeps the high seal performance of the gland packing 200, and in addition, it reduces the resistance of the gland packing 200 to sliding on the stem 510.

The protective layers 221 and 222 cover both axial end surfaces of the seal layer 210. Since fibers of expanded graphite members are complexly intertwined within the braided packing 100, molecules of oxygen and water are not easy to penetrate between the expanded graphite members. Thus, the protective layers 221 and 222 prevent entry of oxygen and moisture into the seal layer 210 from both fluid within the flow channel 540 and the atmosphere outside the stuffing box 520. Especially since the axial thicknesses TP of the protective layers 221 and 222 are designed to be sufficiently large, the seal layer 210 hardly allows entry thereinto of both an amount of oxygen required for oxidative decomposition of PTFE and an amount of moisture required for generation of HF. In addition, the protective layers 221 and 222 do not contain any type of fluororesin. Accordingly, even if the temperature of the gland packing 200 reaches the decomposition temperature of PTFE, 350 degrees Celsius, generation of HF from the gland packing 200 is inhibited. As a result, even if the temperature of the gland packing 200 is maintained at a level higher than the decomposition temperature of PTFE, 350 degrees Celsius, corrosion of the stem 510 by HF hardly proceeds, and thus, the gland packing 200 maintains its high seal performance and the stem 510 hardly loses its durability. This enables the gland packing 200 to be used at temperatures higher than the decomposition temperature of PTFE, 350 degrees Celsius.

Corrosion Test

Figure 3A:
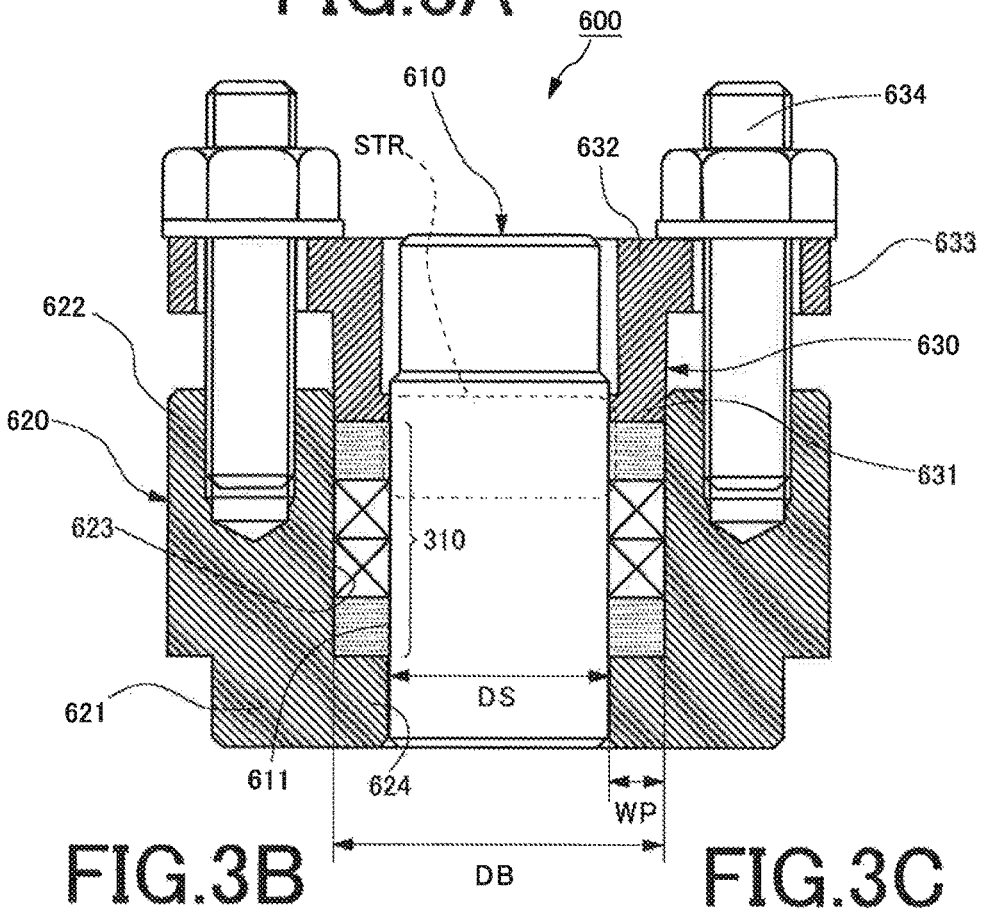
FIG. 3A is a cross-section view of an assembly used in a test of corrosion of a stem by the gland packing.

Corrosion-prevention effect of the protective layers 221 and 222 on the stem 510 was confirmed by corrosion tests described below. FIG. 3A is a cross-section view of an assembly 600 used in the corrosion tests. The assembly 600 is a model of the shaft seal assembly 500, which surrounds a simulated stem 610, i.e., a model of the stem 510, for example, a SUS 403 round bar of a diameter DS=32 mm. The cross section in FIG. 3A includes the center axis of the simulated stem 610. In FIG. 3A, the center axis is parallel to the vertical direction, and the upper and lower sides are assumed to be the atmosphere and fluid sides, respectively.

The assembly 600 includes a stuffing box 620 and a gland follower 630. The stuffing box 620 is a circular-cylindrical member coaxially surrounding the simulated stem 610, whose inner periphery 623 forms a circular-annular packing chamber (e.g., its inner diameter DS=32 mm, its outer diameter DB=48 mm) between the inner periphery 623 and an outer periphery 611 of the simulated stem 610. The packing chamber is filled with a gland packing 310 to be tested. A circular-annular rib 624 extends from the fluid-side end 621 (the lower end in FIG. 3A) of the stuffing box 620 toward the outer periphery 611 of the simulated stem 610 to form a bottom of the packing chamber. The gland follower 630 is a circular-annular member coaxially surrounding the simulated stem 610 on the atmosphere side (the upper side in FIG. 3A) of the stuffing box 620, whose fluid-side end 631 (lower end in FIG. 3A) closes an atmosphere-side opening (the upper-side opening in FIG. 3A) of the packing chamber. From the atmosphere-side end 632 (the upper end in FIG. 3A) of the gland follower 630, a circular-annular flange 633 extends radially outward and is fixed to an atmosphere-side end 622 of the stuffing box 620 with a plurality of bolts 634.

Figure 3B:
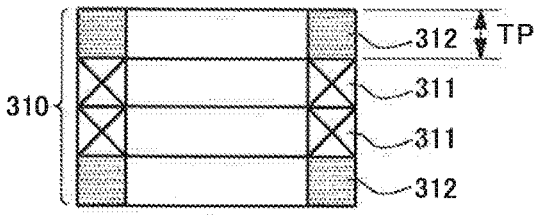
FIG. 3B is a schematic cross-section view of a first test object.
Figure 3C:
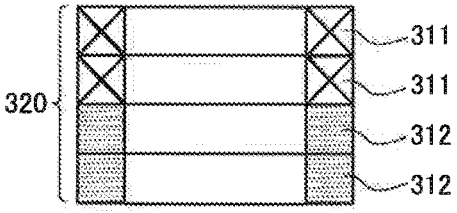
FIG. 3C is a schematic cross-section view of a second test object.

As gland packings to be tested, two types of test objects, i.e., a first test object 310 and a second test object 320, were prepared. FIG. 3B is a schematic cross-section view of the first test object 310, and FIG. 3C is a schematic cross-section view of the second test object 320. Each of the test objects 310 and 320 includes two first rings 311 and two second rings 312. Each of the rings 311 and 312 is formed into a circular-ring shape by compression molding to have the same inner diameter equal to or smaller than the diameter DS=32 mm of the simulated stem 610 and the same radial width equal to or larger than the radial span WP=(DB−DS)/2=8 mm of the packing chamber. The first rings 311 have the same axial thickness, and the second rings 312 have the same axial thickness, and the total thickness of the four rings 311 and 312 is about 20 mm. The first rings 311 and the second rings 312 are different in presence or absence of fluororesin. More specifically, the first rings 311 contain PTFE, while the second rings 312 contain no fluororesin. The four rings 311 and 312 are packed into the packing chamber and aligned side by side along the simulated stem 610, and thus, the test objects 310 and 320 form tubular structures, which differ in sequence of the four rings 311 and 312. As shown in FIG. 3B, the axial center portion of the first test object 310 consists of the first rings 311, and both the axial ends thereof consist of the second rings 312. As shown in FIG. 3C, the upper half, i.e., the atmosphere side of the second test object 320 consists of the first rings 311, and the lower half, i.e., the fluid side thereof consist of the second rings 312.

The tests were performed as follows. First, the test object 310 or 320 is packed into the packing chamber, and the atmosphere-side opening of the packing chamber is closed with the gland follower 630. Next, tightening torques of the bolts 634 are adjusted such that the fluid-side end 631 (the lower end in FIG. 3A) of the gland follower 630 pushes the test object 310 or 320 against the rib 624, for example, under pressure of 30 $N/mm^2$. This compresses the test object 310 or 320 axially (vertically in FIG. 3A), and then, the test object 310 or 320 expands radially (horizontally in FIG. 3A) to more closely contact the inner periphery 623 of the stuffing box 620 and the outer periphery 611 of the simulated stem 610. Subsequently, the assembly 600 under that configuration is heated in an electric furnace, and its temperature is kept for 24 hours at a level higher than the decomposition temperature of PTFE, 350 degrees Celsius, e.g., 400 degrees Celsius. After the assembly 600 is cooled until its temperature falls to room temperature, the simulated stem 610 is ejected from the assembly 600 to be visually checked whether there is corrosion on its surfaces.

Figure 3D:
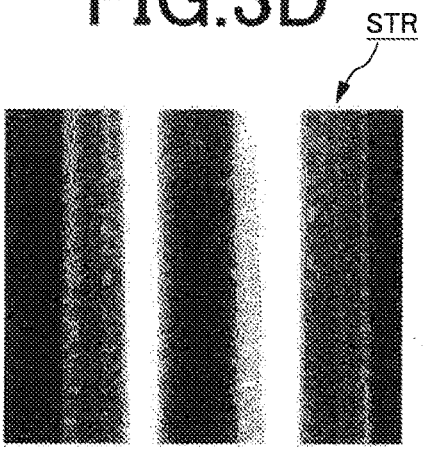
FIG. 3D is an enlarged view of a surface of a simulated stem that was in contact with the first test object.
Figure 3E:
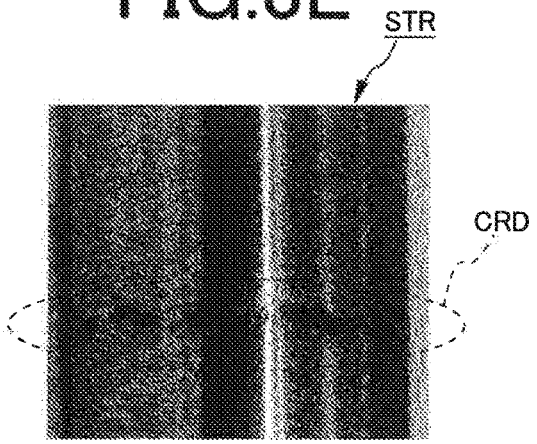
FIG. 3E is an enlarged view of a surface of a simulated stem that was in contact with the second test object.

The results of the visual check were as follows. FIG. 3D is an enlarged view of a surface of the simulated stem 610 that was in contact with the first test object 310, and FIG. 3E is an enlarged view of a surface of the simulated stem 610 that was in contact with the second test object 320. Each of those enlarged views shows a surface portion of the simulated stem 610 that was in contact with the atmosphere-side end of the test object 310 or 320, more specifically a portion STR surrounded by the broken line shown in FIG. 3A. FIG. 3D shows that no corrosion was found in the surface portion of the simulated stem 610, while FIG. 3E shows that corrosion CRD was found in the surface portion of the simulated stem 610 (cf. the portion surrounded by the broken line in FIG. 3E).

The corrosion CRD appearing in the surface portion of the second test object 320 was caused by HF generated through oxidative decomposition of PTFE contained in the first rings 311. Between the test objects 310 and 320, no differences were found in conditions that can affect a generated amount of HF, such as a contained amount of PTFE, except for arrangement of the rings 311 and 312. Accordingly, the following was found from presence or absence of the corrosion CRD. In contrast to the second test object 320, the first test object 310 makes the second rings 312 isolate the first rings 311 from outside air, and thus, oxygen and moisture hardly enter the first rings 311. As a result, even under high temperature of 400 degrees Celsius, an amount of HF generated from PTFE in the first rings 311 is reduced to such a level that HF does not substantially corrode surfaces of the simulated stem 610.

From the above-described test results, the following is concluded. The first rings 311 have the same structure as the seal layer 210 of the gland packing 200 in FIG. 2, and the second rings 312 have the same structure as the protective layers 221 and 222 of the gland packing 200. Accordingly, even under high temperature of 400 degrees Celsius, only the amount of HF that does not substantially corrode surfaces of the stem 510 should be generated from PTFE in the seal layer 210 since the protective layers 221 and 222 cover either end surface of the seal layer 210 to prevent entry of oxygen and moisture into the seal layer 210.

The first test object 310 was further examined for how the axial thickness TP of the second ring 312 relates to the diameter DS of the simulated stem 610. More specifically, the corrosion tests for the first test object 310 were performed according to the above-described steps, by using three types of the simulated stem 610 whose diameters DS were 19 mm, 24 mm, and 32 mm. The simulated stem 610 of a diameter DS=19 mm is installed in the packing chamber of an outer diameter DB=28.6 mm, the simulated stem 610 of a diameter DS=24 mm is installed in the packing chamber of an outer diameter DB=37 mm, and the simulated stem 610 of a diameter DS=32 mm is installed in the packing chamber of an outer diameter DB=48 mm. The rings 311 and 312 have the same inner diameter equal to or smaller than the diameter DS of the simulated stem 610 and the same radial width equal to or larger than the radial span WP=(DB−DS)/2 of the packing chamber. The test for the simulated stem 610 of the diameter DS=19 mm used two types of the second rings 312 whose axial thicknesses TP were designed to be 2 mm and 5 mm. The test for the simulated stem 610 of the diameter DS=24 mm used two types of the second rings 312 whose axial thicknesses TP were designed to be 3 mm and 5 mm. The test for the simulated stem 610 of the diameter DS=32 mm used three types of the second rings 312 whose axial thicknesses TP were designed to be 4 mm, 5 mm, and 7 mm.

Table 1 shows results of the corrosion tests that were performed according to the above-described steps.

TABLE 1

| | TP (mm) | 2 | 5 |
|---|---|---|---|
| DS = 19 mm<br>DB = 28.6 mm | CORROSION | PRESENCE | ABSENCE |

| | TP (mm) | 3 | 5 |
|---|---|---|---|
| DS = 24 mm<br>DB = 37 mm | CORROSION | PRESENCE | ABSENCE |

| | TP (mm) | 4 | 5 | 7 |
|---|---|---|---|---|
| DS = 32 mm<br>DB = 48 mm | CORROSION | PRESENCE | ABSENCE | ABSENCE |

As shown in Table 1, when the axial thickness TP of the second ring 312 was 5 mm, no corrosion was found in surfaces of all the simulated stems 610, but when the axial thickness TP was smaller than 5 mm, corrosion was found in surfaces of all the simulated stems 610. From those results, the following is expected. As long as the protective layers 221 and 222 of the gland packing 200 have an axial thickness TP equal to or larger than 5 mm (TP≥5 mm), they can block oxygen and moisture from entering the seal layer 210 such that corrosion of the stem 510 is sufficiently prevented regardless of the diameter DS of the stem 510.

Modifications (1) The gland packing 200 is installed in a valve and used for sealing the gap between the opening portion 551 of the casing 550 and the stem 510. However, the gland packing according to the above-described embodiment of the invention may be installed in another type of fluid device and used for sealing the gap between an opening portion of its casing 550 and its movable axis. "Fluid devices" include devices that use motion to change fluid pressure, such as pumps, and devices that use fluid pressure to generate power, such as dynamos, as well as devices that mechanically control flows, such as valves. "Casing" means a box or case that defines a flow channel, such as a pump body. "Movable axis" means a bar-shaped member that transmits power by rotation around or reciprocal motion along its center axis, such as a drive axis of a pump. When power is transmitted to a member located within the flow channel in the casing, such as an impeller or piston of a pump, the casing needs an opening to allow the movable axis to pass therethrough. To prevent fluid leakage from the opening, the gland packing according to the above-described embodiment of the invention can be used.

(2) The transverse cross sections of the braided packing 100 have a square shape, but they may have a rectangular or circular shape. The yarn 120 is a bundle of fibers of expanded graphite members 122 packed withing the tubular member 121, but it may be formed by wound or stacked tapes of expanded graphite. In manufacturing of braided packing 100, the process of forming a bundle of the yarns 120 into a single strip uses eight-carrier braid, but it may use other braid or twist, such as braid over braid or interlocking braid. One or both of the center core 110 and the tubular member 121 may be eliminated since neither of the center core 110 nor the tubular member 121 is a component required for the invention.

(3) The rings 210, 221, and 222 constituting the gland packing 200 are braided packings 100 formed into a circular-ring shape by compression molding, but one or more of them may be strips of the braided packing 100 coaxially wound around the stem 510.

(4) PTFE is incorporated by impregnation into the braided packings 100 constituting the seal layer 210 of the gland packing 200. This impregnation is performed for a bundle of the yarns 120 after intertwined into a single strip, but it may be performed for the individual yarns 120 before intertwined or the individual expanded graphite members 122 before packed into the tubular member 121. In addition, the expanded graphite members 122 within the yarn 120 may be replaced with fluororesin members. As fluororesin, perfluoroalkoxy alkane (PFA), polyvinylidene fluoride (PVDF) or the like may be used instead of PTFE.

(5) In the gland packing 200, both end surfaces of the seal layer 210 are covered with the protective layers 221 and 222. However, to prevent entry of oxygen and moisture into the seal layer 210, it is sufficient that, at least, the atmosphere-side end surface of the seal layer 210 is covered with the protective layer 221. For example, when only a negligible amount of oxygen and moisture enters the fluid side of the seal layer 210 since fluid within the flow channel 540 is a type containing neither oxygen nor water, such as oil, the protective layer 222 that covers the fluid-side end surface of the seal layer 210 may be eliminated.

(6) The seal layer 210 and protective layers 221 and 222 of the gland packing 200 have the same ring structure and the same ring material, except for presence or absence of PTFE. However, the seal layer 210 and protective layers 221 and 222 may differ in ring structure or ring material. In particular, the gland packing may be a combination packing set including seal packings and adapter packings. In this case, the seal layer is the entirety of seal packings, and the protective layer includes at least an adapter packing abutting the atmosphere side of the seal packings. In the other words, due to an adapter packing without fluororesin abutting the atmosphere side of the seal packings, the gland packing according to the invention can be easily assembled from existing members.

(7) The gland packing 200 forms a single tubular structure with the separate rings 210, 221, and 222 assembled within the packing chamber. Alternatively, the rings 210, 221, and 222 may be integrated as a single tubular structure by compression molding before packed into the packing chamber. In this case, the gland packing 200 is easy to handle in the work of packing it into the packing chamber and the likes.

(8) In the gland packing 200, both the seal layer 210 and the protective layers 221 and 222 consist of the braided packings 100, but one or both of them may consist of molded packings.

Figure 4A:
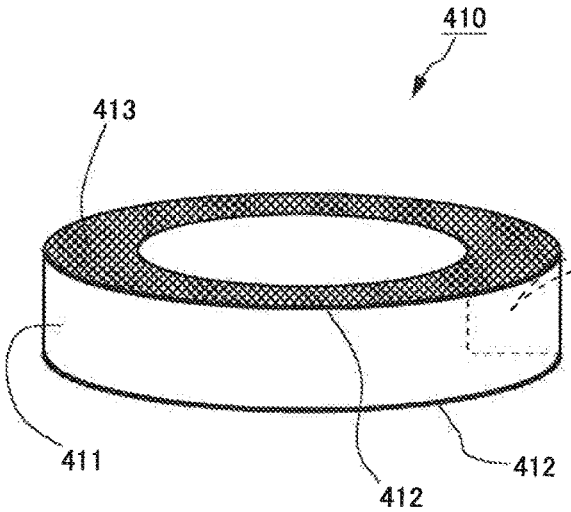
FIG. 4A is a perspective view schematically showing an appearance of a molded packing forming a first modification of the gland packing according to the embodiment of the invention.
Figure 4B:
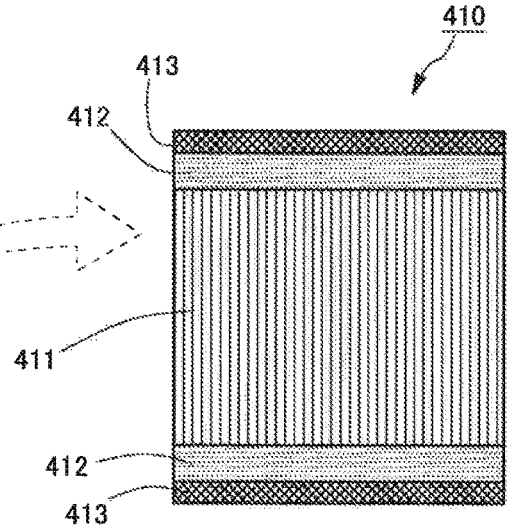
FIG. 4B is a schematic cross-section view of the molded packing of FIG. 4A.

FIG. 4A is a perspective view schematically showing an appearance of a molded packing 410 forming a first modification of the gland packing according to the embodiment of the invention. FIG. 4B is a schematic cross-section view of the molded packing 410. The molded packing 410 is a circular-annular member whose inner diameter is equal to or smaller than the diameter of the stem 510, and whose radial width is equal to or larger than the radial span of the packing chamber. The molded packing 410 includes a body 411, an annular sheet 412, and a mesh 413. The body 411 is, for example, a circular-annular expanded graphite, which includes expanded graphite tapes spirally wound or concentrically arranged, and then, pressed and integrated as a single piece. Caused by this forming, a plurality of layers stacked in the radial direction (the left-right direction in FIG. 4B) appear in a cross section in a plane including the center axis of the body 411. The annular sheet 412 is an expanded graphite sheet stamped into a circular-ring shape, which covers both axial end surfaces (the top and bottom surfaces in FIG. 4B) of the body 411 to prevent entry of fluid into gaps between the layers of the body 411. The mesh 413 consists of, for example, fibers of metal, such as stainless steel, braided into a circular-ring shape, which is coaxially put on the annular sheet 412 and, due to its high mechanical strength, prevents the body 411 from being extruded axially (vertically in FIGS. 4A and 4B).

When the seal layer of the gland packing consists of the molded packings 410, fluororesin such as PTFE, PFA, or PVDF is incorporated into the molded packings 410 by impregnation, which may be performed for finished products of the molded packings 410 or expanded graphite tapes before shaped into the body 411. Alternatively, the body 411 itself may be made of fluororesin. When the axial thickness of the protective layer is sufficiently large, the annular sheet 412 can be eliminated from the molded packings 410 constituting the seal layer. When the mechanical strength of the protective layer is at a sufficient level as an adapter packing, the mesh 413 can be eliminated from the molded packings 410 constituting the seal layer.

The molded packings 410, when used to constitute the protective layer of the gland packing, contain no fluororesin. To prevent entry of oxygen and moisture into gaps between the layers of the body 411, the annular sheet 412 may have any selected thickness or may be made of anything except expanded graphite. The thickness or structure of the mesh 413 may be designed such that the mechanical strength of the protective layer reaches a level required for an adapter packing.

(9) Both the center core 110 and yarns 120 of the braided packing 100 are made of fibers of expanded graphite, but at least one of them may be made of fibers of an inorganic material, such as glass, carbon or ceramics, or metal. Any substance equivalent to expanded graphite in heat resistance, corrosion resistance to and seal performance for fluid in the flow channel 540, workability, mechanical strength and the like is selectable as a material of the braided packing 100.

Figure 4C:
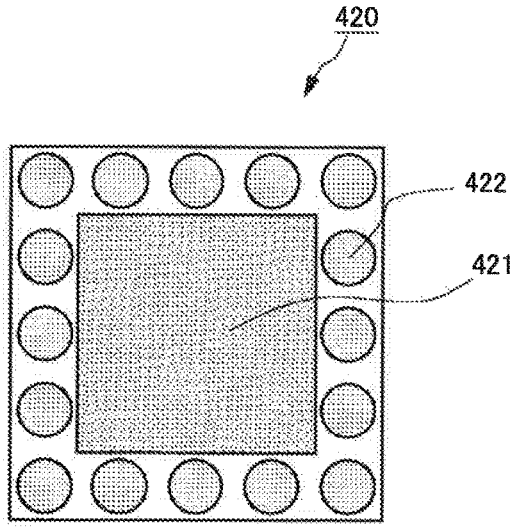
FIG. 4C is a schematic cross-section view of a braided packing forming a second modification of the gland packing according to the embodiment of the invention.

FIG. 4C is a schematic cross-section view of a braided packing 420 forming a second modification of the gland packing according to the embodiment of the invention. The braided packing 420 is a strip-shaped member whose transverse cross sections have a square shape, in which sixteen yarns 422 are braided around a single center core 421. The center core 421 of the braided packing 420 is made of ceramics fibers and the yarns 422 are made of stainless steel, in contrast to those of the braided packing 100 in FIGS. 1A-1C. Thus, the braided packing 420 is superior in heat and chemical resistance. In addition, the braided packing 420 has high mechanical strength, and accordingly, it is desirable that the braided packing 420 is incorporated into the gland packing as an adapter packing. In this case, the braided packing 420 is designed to have a sufficiently large axial thickness so that it can also function as the protective layer of the gland packing.

Figure 4D:
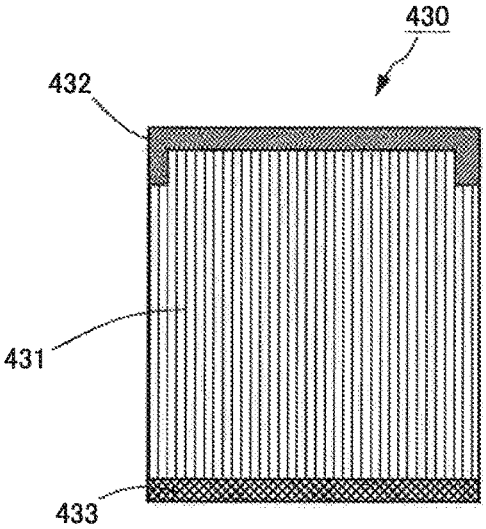
FIG. 4D is a schematic cross-section view of a protective layer of a third modification of the gland packing according to the embodiment of the invention.

(10) The atmosphere-side end of the protective layer of the gland packing may be covered with a metallic plate. FIG. 4D is a schematic cross-section view of a protective layer 430 of a third modification of the gland packing according to the embodiment of the invention. The protective layer 430 is a circular-annular molded packing and includes a body 431, a metallic cap 432, and a mesh 433. The body 431 is, for example, a circular-annular expanded graphite member, in which expanded graphite tapes are spirally wound or concentrically arranged, and then, pressed and integrated as a single piece. Alternatively, the body 431 may be formed by a braided packing. Regardless of which structure the body 431 has, no fluororesin is incorporated into the body 431. The metallic cap 432 is, for example, a circular-annular metallic plate, which consists of thin wires of metal such as stainless steel packed into a circular-annular metallic mold, and then, pressed and integrated as a single piece. The metallic cap 432 covers the atmosphere-side end surface (the top surface in FIG. 4D) of the body 431. The mesh 433 consists of, for example, fibers of metal such as stainless steel braided into a circular-ring shape and covers the fluid-side end surface (the bottom surface in FIG. 4D) of the body 431. Both the metallic cap 432 and mesh 433 have high mechanical strength, and thus, they prevent not only axial (vertical in FIG. 4D) extrusion of the body 431 but also extrusion of the seal layer toward the protective layer 430. The metallic cap 432 further blocks components of outside air, esp. oxygen and moisture. In this manner, the metallic cap 432 enables the protective layer 430 to enhance its original function of preventing oxygen and moisture from entering the seal layer, and in addition, to achieve the function of increasing the mechanical strength of the seal layer.

Figure 5:
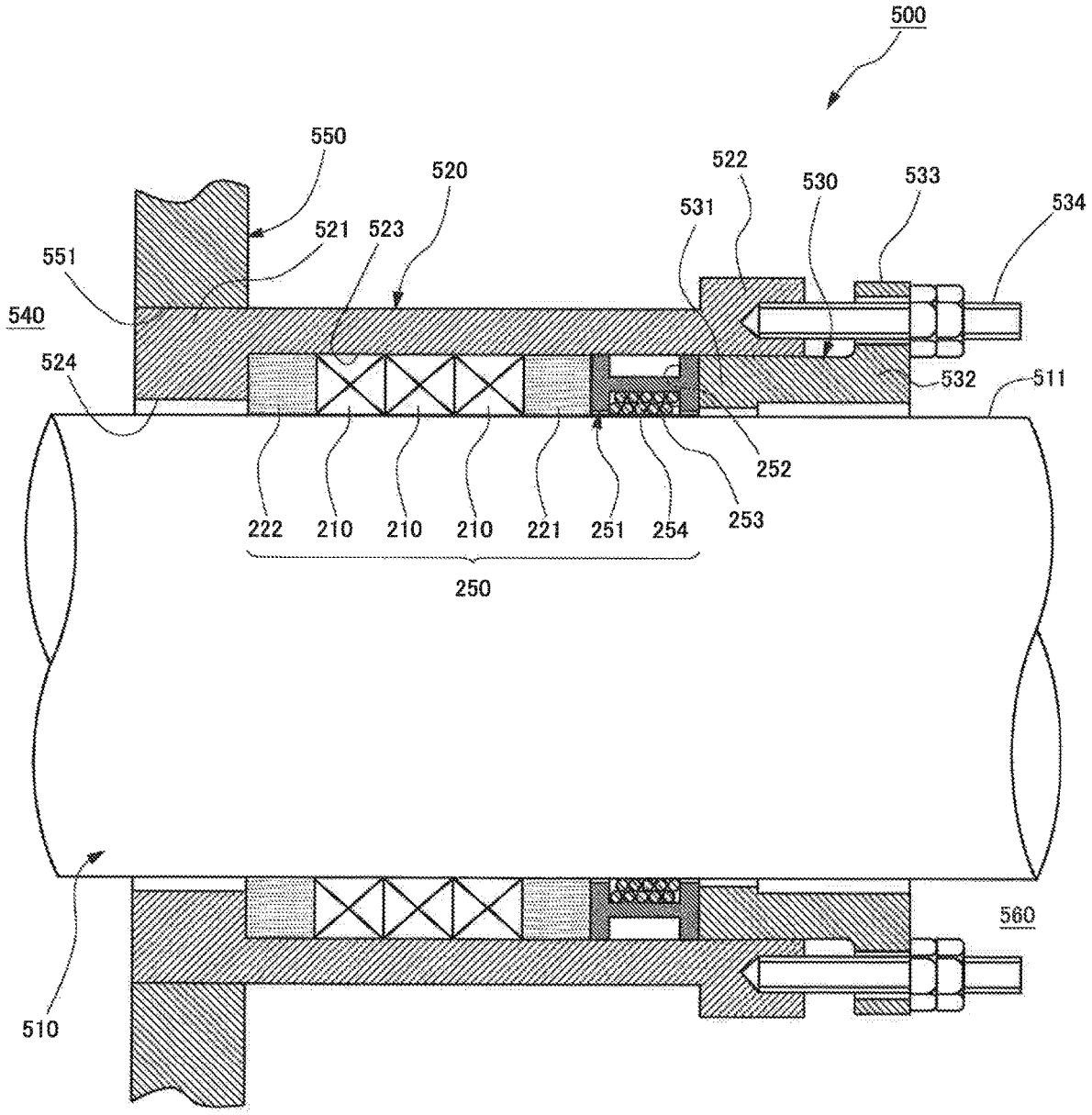
FIG. 5 is a cross-section view of a fourth modification of the gland packing according to the embodiment of the invention and a shaft seal assembly.

(11) The gland packing may further include a sacrifice member. FIG. 5 is a cross-section view of a fourth modification of the gland packing 250 according to the embodiment of the invention and a shaft seal assembly 500. The gland packing 250 includes a sacrifice member 251 in addition to the seal layer 210 and protective layers 221 and 222 of the gland packing 200 in FIG. 2. The sacrifice member 251 is, for example, an annular member made of resin or metal, and contains no fluororesin like the protective layers 221 and 222, and preferably, its inner diameter is slightly larger than the diameter of the stem 510. Preferably, an existing lantern ring is used as the sacrifice member 251. In this case, the sacrifice member 251 has a H-shaped cross section in a plane including the center axis of the sacrifice member 251, i.e., circumferential grooves 252 and 253 on the outer and inner peripheries of the sacrifice member 251, respectively. The outer peripheral groove 252 may communicate with the inner peripheral groove 253 through a radial hole (not shown). The sacrifice member 251 abuts the atmosphere-side protective layer 221. Accordingly, when the fluid-side end 531 (the left end in FIG. 5) of the gland follower 530 pushes the sacrifice member 251 toward the fluid side (leftward in FIG. 5), the seal layer 210 is compressed axially (horizontally in FIG. 5).

One or more wire members 254 made of sacrifice metal are packed within the inner peripheral groove 253 of the sacrifice member 251. The sacrifice metal is metal whose corrosion resistance to HF is poorer than that of material of the stem 510. For example, when the material of the stem 510 is cast iron, cast steel, or stainless steel, the sacrifice metal is preferably aluminum or nickel. For example, transverse cross sections of each wire member 254 have a disc shape, whose diameter is sufficiently smaller than both the radial thickness and axial width of the groove 253. At least one turn of each wire member 254 is wound around the stem 510 along the groove 253. Preferably, the inner diameter of the turn is larger than the diameter of the stem 510. Thus, the wire members 254 do not contact the stem 510, and this reduces not only the resistance of the gland packing 250 to sliding on the stem 510, but also pieces of the sacrifice metal peeling off the wire members 254 due to friction against the stem 510. Accordingly, there is a low risk that the pieces of the sacrifice metal enter the gap between the stem 510 and the protective layer 221 and proceed to the gap between the stem 510 and the seal layer 210 to expedite abrasion of the protective layer 221 and seal layer 210.

Since the gland packing 250 is equipped with the wire members 254 made of the sacrifice metal, it can more significantly delay corrosion of the stem 510 by HF for a longer time. This is because of the following reason. Strictly speaking, a slight amount of oxygen and moisture in outside air can penetrate the protective layers 221 and 222 and enter the seal layer 210. Accordingly, a slight amount of HF can be generated from the seal layer 210 while the temperature of the gland packing 250 is kept at a level higher than the decomposition temperature of PTFE. If duration of use of the gland packing 250 under such high temperature reaches a few years, for example, the total amount of HF generated during the duration can increase to a significant degree. However, the sacrifice metal is easier to be corroded by HF than the material of the stem 510, and accordingly, the slight amount of HF generated from the seal layer 210 is spent mainly on corrosion of the wire members 254 of the sacrifice metal, and thus, there remains no substantial amount of HF corroding the stem 510. As a result, actual corrosion of the stem 510 does not proceed even if duration of use of the gland packing 250 under the high temperature reaches a few years.

In the example shown in FIG. 5, the wire members 254 of the sacrifice metal are packed only into the inner peripheral groove 253 of the sacrifice member 251. However, the invention is not limited to that, but the wire members 254 may be packed into the outer peripheral groove 252 of the sacrifice member 251. In the example shown in FIG. 5, transverse cross sections of the wire members 254 have a disc shape, but the invention is not limited to that. The transverse cross sections may have an elliptic or polygonal profile, or alternatively, a wavy or zigzag profile due to unevenness such as grooves or dents on surfaces of the wire members 254. This provides the wire members 254 with an increased surface area per unit volume, thus ensuring a sufficiently large area thereof that can contact HF. In addition, the sacrifice metal may be formed into a band or ring shape, instead of the wire members 254. Alternatively, the sacrifice metal may be formed into a film covering at least a portion of surfaces of the outer peripheral groove 252 or inner peripheral groove 253 of the sacrifice member 251, or into a plurality of protrusions whose one portions embedded into the surfaces and other portions extending inside the groove 252 or 253.

In the example shown in FIG. 5, an existing lantern ring is used as the sacrifice member 251. Alternatively, a member specialized as the sacrifice member may be made of resin or metal. This member has a hole, dent, or groove on a surface thereof, or a cavity thereinside, and the sacrifice metal is placed within the hole, dent, groove, or cavity. It is sufficient that the hole, dent, or groove is located, or the cavity communicates with the atmosphere, such that the sacrifice metal is exposed to HF generated from the seal layer 210.

In the example shown in FIG. 5, the sacrifice member 251 is placed only on the atmosphere side of the atmosphere-side protective layer 221. This is the case where an amount of oxygen and moisture entering the fluid-side protective layer 222 is significantly smaller than that entering the atmosphere-side protective layer 221. In other cases, the sacrifice member may be placed on the fluid side of the fluid-side protective layer 222 to further reduce the generated amount of HF.

REFERENCE NUMBER LIST

100 braided packing, 110 center core, 120 yarn, 121 tubular members, 122 expanded graphite member, 123 fibrous member, 200 gland packing, 210 seal layer, 221, 222 protective layers, 500 shaft seal assembly, 510 stem, 511 outer periphery of the stem, 520 stuffing box, 521 fluid-side end of the stuffing box, 522 atmosphere-side end of the stuffing box, 523 inner periphery of the stuffing box, 524 rib of the stuffing box, 530 gland follower, 531 fluid-side end of the gland follower, 532 atmosphere-side end of the gland follower, 533 flange of the gland follower, 534 bolt, 540 flow channel, 550 casing, 551 opening of the casing, 560 exterior spaces of the casing.

What is claimed is:

1. A gland packing comprising:

a seal layer that is a tubular portion containing fluororesin, whose outer periphery is in close contact with an inner periphery of a stuffing box, and whose inner periphery is in close contact with an outer periphery of a movable shaft of a fluid device;

a protective layer that is an annular portion containing no fluororesin, and that covers an atmosphere-side axial end surface of the seal layer to prevent oxygen and moisture from entering the seal layer; and a metallic plate that covers an atmosphere-side axial end of the protective layer.

2. The gland packing according to claim 1 that is a combination packing set including a seal packing and one or more adapter packings, wherein:

the seal layer includes the entirety of the seal packing; and the protective layer includes one of the adapter packings that abuts an atmosphere side of the seal packing.

3. The gland packing according to claim 1 wherein the seal layer and the protective layer are integrated as a single piece by compression molding.

4. The gland packing according to claim 1 wherein an axial thickness of the protective layer is 5 mm or more regardless of a diameter of the movable shaft.

5. A gland packing comprising:

a seal layer that is a tubular portion containing fluororesin, whose outer periphery is in close contact with an inner periphery of a stuffing box, and whose inner periphery is in close contact with an outer periphery of a movable shaft of a fluid device;

a protective layer that is an annular portion containing no fluororesin, and that covers an atmosphere-side axial end surface of the seal layer to prevent oxygen and moisture from entering the seal layer; and a sacrifice member that is an annular member abutting an atmosphere side of the protective layer, and including sacrifice metal whose corrosion resistance to hydrogen fluoride is poorer than that of material of the movable shaft.

6. The gland packing according to claim 5 wherein:

the sacrifice member has a hole, dent, or groove on a surface thereof, or a cavity thereinside, and the sacrifice metal is placed within the hole, dent, groove, or cavity.

* * * * *